US010655906B2

(12) United States Patent
Okazaki et al.

(10) Patent No.: US 10,655,906 B2
(45) Date of Patent: May 19, 2020

(54) REFRIGERATOR

(71) Applicant: PANASONIC CORPORATION, Osaka (JP)

(72) Inventors: Toru Okazaki, Osaka (JP); Terutsugu Segawa, Osaka (JP); Yasuhiro Asaida, Kyoto (JP)

(73) Assignee: PANASONIC CORPORATION, Osaka (JP)

( * ) Notice: Subject to any disclaimer, the term of this patent is extended or adjusted under 35 U.S.C. 154(b) by 17 days.

(21) Appl. No.: 15/974,471

(22) Filed: May 8, 2018

(65) Prior Publication Data

US 2018/0328649 A1 Nov. 15, 2018

(30) Foreign Application Priority Data

May 10, 2017 (JP) ..... 2017-093807

(51) Int. Cl.
*F25D 23/00* (2006.01)
*F25D 23/08* (2006.01)
*F25D 23/02* (2006.01)

(52) U.S. Cl.
CPC ..... *F25D 23/087* (2013.01); *F25D 23/028* (2013.01); *F25D 2201/10* (2013.01); *F25D 2600/04* (2013.01)

(58) Field of Classification Search
CPC .. F25D 23/087; F25D 23/028; F25D 2201/10; F25D 2600/04; F25D 29/005; F25D 23/02; F25D 23/00; F25D 25/02; F25D 25/00; F25D 25/025; F25D 23/021; F25D 23/067; A47B 96/16; A47B 67/04
USPC ..... 312/296, 401, 405; 49/475.1, 477.1, 49/489.1, 495.1, 498.1
See application file for complete search history.

(56) References Cited

U.S. PATENT DOCUMENTS 1,481,451 A * 1/1924 Wirfs ..... F25D 23/087 180/69.25
2,591,003 A * 4/1952 Philipp ..... F25D 23/082 49/484.1
4,241,337 A * 12/1980 Prada ..... F25D 29/008 200/61.69

(Continued)

FOREIGN PATENT DOCUMENTS

BR 640892 * 8/1950
JP H0443786 U 4/1992

(Continued)

OTHER PUBLICATIONS

CN 203310191; Chen et al; figure and abstract (Year: 2013).*
CN 201867013; Ding; figure and abstract (Year: 2011).*
CN 201779936; Cai et al; figure and abstract (Year: 2011).*

*Primary Examiner* — Janet M Wilkens
(74) *Attorney, Agent, or Firm* — McDermott Will & Emery LLP

(57) ABSTRACT

A refrigerator is provided with first gasket and second gasket. First gasket is provided on door, and when door is closed, first gasket makes contact with refrigerator main body and closes the storage compartment. Second gasket is provided with heat insulator, and is provided on refrigerator main body on the storage compartment side relative to the location where first gasket adheres. Accordingly, it is possible to achieve refrigerator that can suppress reduction in cooling efficiency due to second gasket heated by heat dissipation pipe.

5 Claims, 4 Drawing Sheets

(56) References Cited

U.S. PATENT DOCUMENTS

| | | | | | |
|---|---|---|---|---|---|
| 5,297,360 | A * | 3/1994 | Besore | F25D 23/087 49/478.1 |
| 2003/0222553 | A1* | 12/2003 | Lee | F25D 23/087 312/296 |
| 2005/0242529 | A1* | 11/2005 | Kim | F25D 23/087 277/628 |
| 2008/0263963 | A1* | 10/2008 | Lee | F25D 23/087 49/475.1 |
| 2018/0073800 | A1* | 3/2018 | Okazaki | F25D 23/08 |

FOREIGN PATENT DOCUMENTS

| | | | |
|---|---|---|---|
| JP | 10259983 | * | 9/1998 |
| JP | 2004340420 | * | 12/2004 |
| JP | 2011237117 | * | 11/2011 |
| JP | 2018044756 | * | 3/2018 |
| KR | 20030085305 | * | 11/2003 |
| WO | 2006107180 | * | 10/2006 |
| WO | 2011142128 | * | 11/2011 |

* cited by examiner

REFRIGERATOR

CROSS REFERENCE TO RELATED APPLICATIONS

This application is entitled to and claims the benefit of Japanese Patent Application No. 2017-093807, filed on May 10, 2017, the disclosure of which including the specification, drawings and abstract is incorporated herein by reference in its entirety.

TECHNICAL FIELD

The present disclosure relates to a refrigerator that includes, in addition to a first gasket, a second gasket provided on a storage compartment side relative to the first gasket for the purpose of increasing the sealing performance of the storage compartment.

BACKGROUND ART

Conventionally, a refrigerator is known in which, in addition to a first gasket having a magnet and the like, a second gasket provided on a storage compartment side relative to the first gasket is provided for the purpose of reducing escaping of cold air from a storage compartment (see, for example, PTL 1).

CITATION LIST

Patent Literature

PTL 1

Japanese Unexamined Utility Model Registration Application Publication No. H04-043786

SUMMARY OF INVENTION

Technical Problem

A refrigerator provided with such a second gasket can suppress escaping of cold air from the storage compartment; however, in such a refrigerator, a door might be heated by heat that is conducted from a heat dissipation pipe that dissipates heat of a compressor to the door side through the second gasket, and consequently the cooling efficiency of the storage compartment might be reduced. Also, when the heat of the heat dissipation pipe heats the second gasket, the storage compartment is heated by heat dissipation from the second gasket, and the cooling efficiency might be reduced.

Conventionally, reduction in cooling efficiency due to the second gasket heated by the heat dissipation pipe has not been sufficiently considered.

An object of the present disclosure is to provide a refrigerator that can suppress reduction in cooling efficiency due to a second gasket heated by a heat dissipation pipe.

Solution to Problem

To achieve the above-mentioned object, a refrigerator of the present disclosure includes: a first gasket provided on a door of the refrigerator, and configured to make contact with a refrigerator main body when the door is closed; and a second gasket disposed on a side surface of the refrigerator main body at a position on a storage compartment side, and including a heat insulator.

Advantageous Effects of Invention

According to the present disclosure, it is possible to suppress reduction in cooling efficiency due to a second gasket heated by a heat dissipation pipe.

DESCRIPTION OF EMBODIMENTS

An embodiment of the present disclosure is elaborated below with reference to the accompanying drawings.

<1> Embodiment

<1-1> General Configuration of Refrigerator

Figure 1:
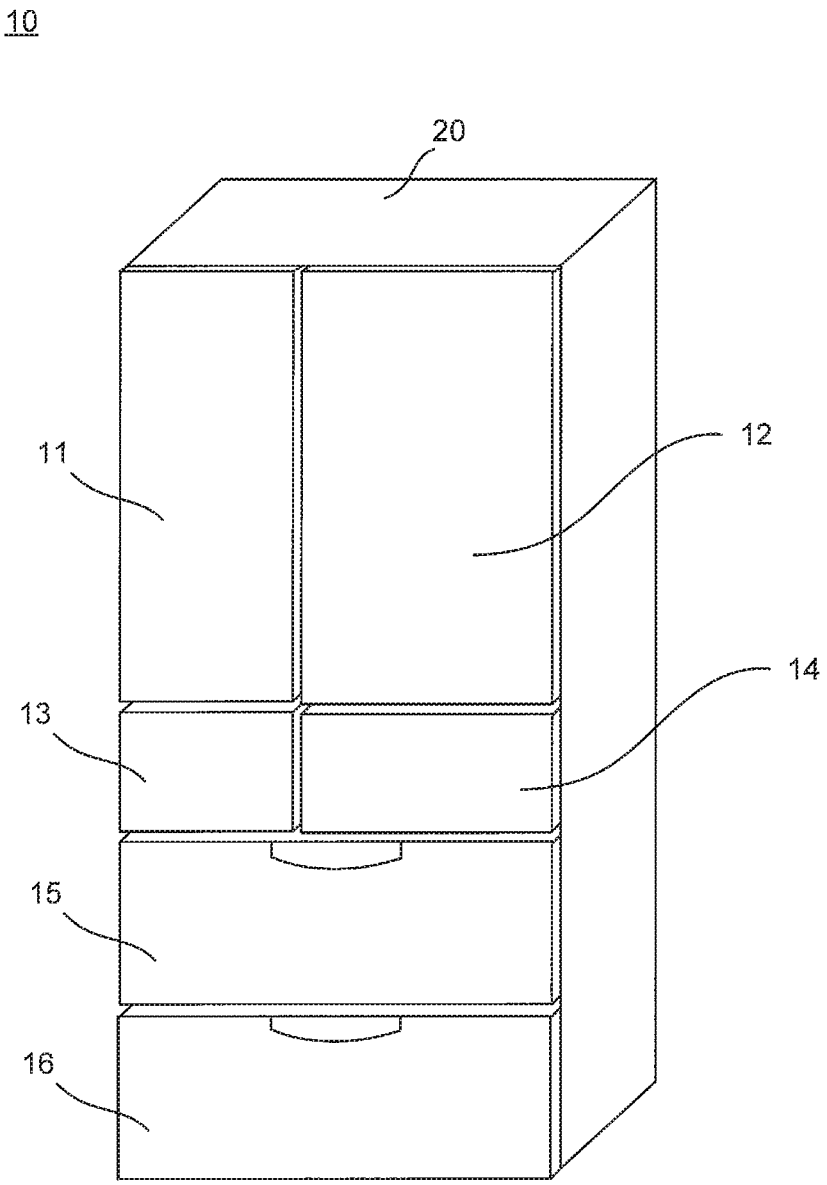
FIG. 1 is a perspective view illustrating a general configuration of a refrigerator according to an embodiment.
Figure 2:
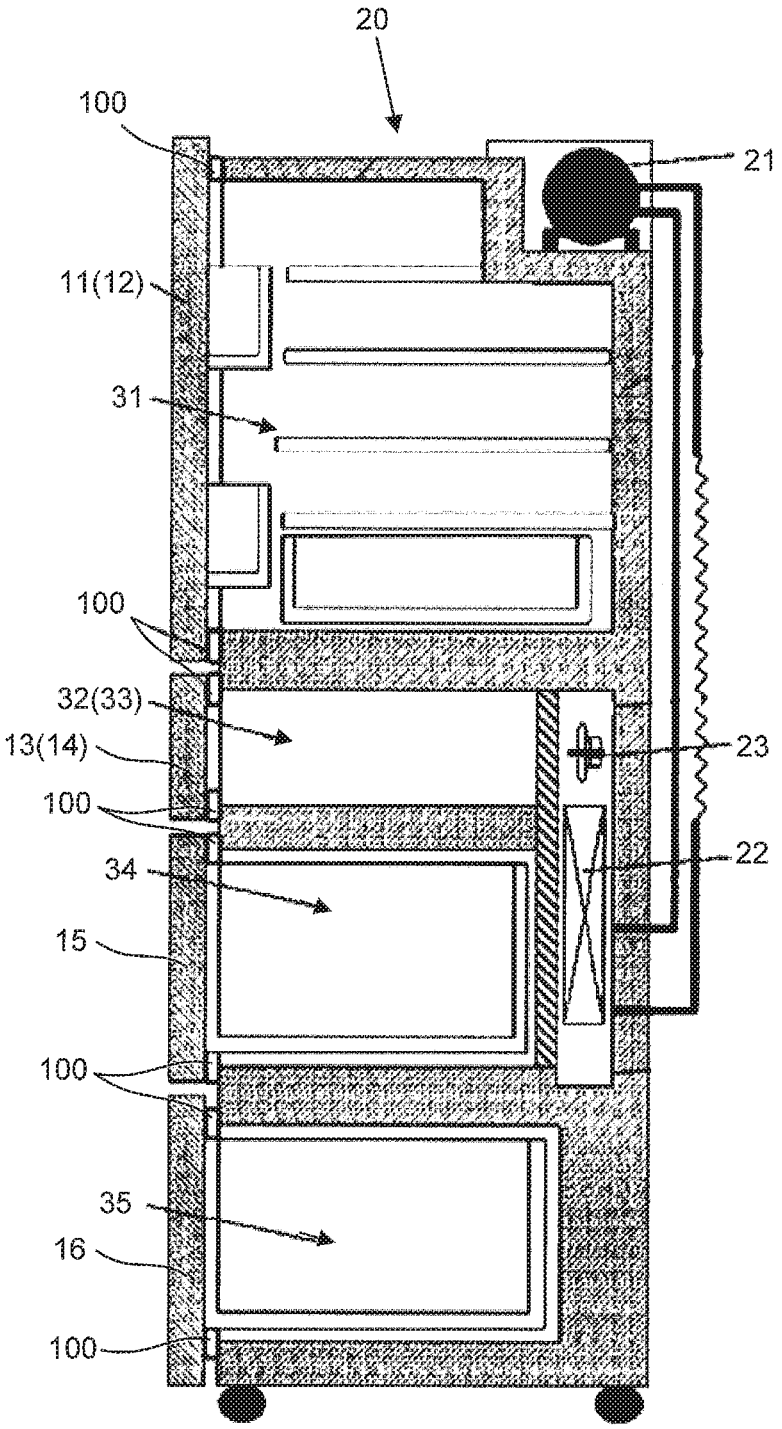
FIG. 2 is a sectional view of the refrigerator of FIG. 1.

FIG. 1 is a perspective view illustrating a general configuration of refrigerator 10 of the present embodiment, and FIG. 2 is a sectional view of refrigerator 10.

Refrigerator 10 includes refrigerator main body 20, and a plurality of openable doors 11 to 16 attached on refrigerator main body 20. To be more specific, first and second turning doors 11 and 12 are provided on the front side of refrigerating compartment 31. A plurality of drawer-type doors, namely, ice compartment door 13, upper freezing compartment door 14, lower freezing compartment door 15 and vegetable compartment door 16, are provided on the lower side of first and second turning doors 11 and 12. Ice compartment door 13 is provided on the front side of ice compartment 32, upper freezing compartment door 14 is provided on the front side of upper freezing compartment 33, lower freezing compartment door 15 is provided on the front side of lower freezing compartment 34, and vegetable compartment door 16 is provided on the front side of vegetable compartment 35.

In addition, refrigerator 10 includes compressor 21, condenser 22, cooling fan 23 and the like for generating and sending cold air to refrigerating compartment 31, ice compartment 32, freezing compartments 33 and 34 and vegetable compartment 35.

Further, gasket 100 for preventing escaping of cold air from a storage compartment (refrigerating compartment 31, ice compartment 32, freezing compartments 33 and 34, and vegetable compartment 35) is provided between refrigerator main body 20 and each of doors 11 to 16.

<1-2> Gasket

Figure 3:
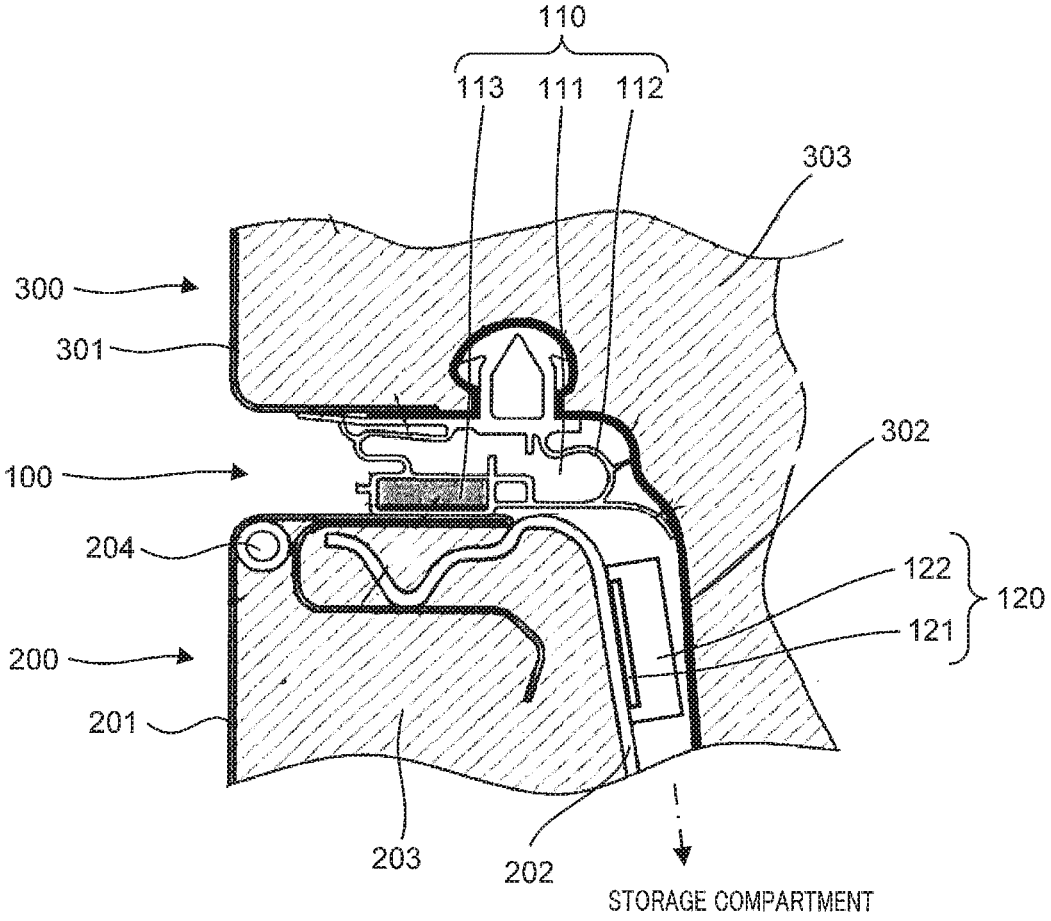
FIG. 3 is a sectional view illustrating a configuration of a gasket of the embodiment.

FIG. 3 is a sectional view illustrating a configuration of the gasket of the present embodiment. It is to be noted that refrigerator main body 20 is indicated by reference numeral "200," and each of doors 11 to 16 is indicated by reference numeral "300" for the sake of convenience in FIG. 3.

Refrigerator main body 200 includes outer case 201 mainly formed of a steel sheet or the like, inner case 202 formed of ABS resin or the like, and heat insulator 203 formed of urethane foam or the like provided between outer case 201 and inner case 202. In addition, refrigerator main body 200 includes heat dissipation pipe 204. Heat dissipation pipe 204 is provided near outer case 201 and gasket 100. Heat dissipation pipe 201 is coupled with compressor 21, and serves a function of dissipating heat generated by compressor 21 to the outside air. In addition, heat dissipation pipe 201 serves a function of preventing condensation at gasket 100 and outer case 201 by heating outer case 201 in the proximity of gasket 100.

Door 300 has a configuration in which heat insulator 303 formed of urethane foam or the like is provided between outer door plate 301 and inner door plate 302.

Gasket 100 includes first gasket 110 provided on door 300, and second gasket 120 provided on refrigerator main body 200.

First gasket 110 provided on door 300 protrudes toward refrigerator main body 200, and, in the state where door 300 is closed, closes the storage compartment (refrigerating compartment 31, ice compartment 32, freezing compartments 33 and 34, or vegetable compartment 35) by making contact with refrigerator main body 200. First gasket 110 includes flexible section 112 having inner air chamber 111, and magnet 113. With this configuration, first gasket 110 adheres to outer case 201 of refrigerator main body 200 with the magnetic force of magnet 113. In addition, first gasket 110 suppresses heat conduction to the interior of the storage compartment with the heat insulating effect by air chamber 111.

Second gasket 120 is provided on the side surface of refrigerator main body 200 such that second gasket 120 protrudes toward door 300 at a position on the storage compartment side relative to the location where first gasket 110 adheres. With this configuration, in the state where door 300 is closed, second gasket 120 reduces the air flow between first gasket 110 and the storage compartment by narrowing and reducing the gap between door 300 and refrigerator main body 200. In this manner, in comparison with the case where only first gasket 110 is provided, leakage of cold air through gasket 100 can be reduced.

Second gasket 120 is composed of heat insulator 121 and covering member 122 that covers heat insulator 121 and has a rigidity higher than that of heat insulator 121. Heat insulator 121 is formed of thin urethane foam for example. In addition, heat insulator 121 may be formed of a combination of heat insulating beads and a fiber structure such as an aerogel non-woven fabric composite heat insulator that provides a thermal conductivity equal to that of thick urethane foam even with a small thickness, for example. Covering member 122 is formed of PVC (polyvinyl chloride) for example. Second gasket 120 is firmly fixed on refrigerator main body 200 with an adhesive agent.

The aerogel non-woven fabric composite heat insulator is a heat insulator in which aerogel is provided between non-woven fabric fibers, and thus provides the strength of the fiber and the high heat insulating property of the aerogel. The fiber also allows for deformation. The thermal conductivity of the aerogel non-woven fabric composite heat insulator is 15 mW/mK to 30 mW/mK, both inclusive. The thermal conductivity of the urethane and the like is equal to or greater than 100 mW/mK. With this configuration, the aerogel non-woven fabric composite heat insulator can provide a heat insulating property equal to that of urethane and the like even with a thickness of one-third to one-fifth of urethane and the like. Accordingly, it is preferable to use an aerogel non-woven fabric composite heat insulator as the heat insulator.

In the above-mentioned configuration, refrigerator 10 of the present embodiment includes, in addition to first gasket 110, second gasket 120 disposed on the storage compartment side relative to first gasket 110, and thus can suppress escaping of cold air from the storage compartment in comparison with the case where only first gasket 110 is provided.

It should be noted that, since second gasket 120 is attached on refrigerator main body 200 (20), heat from heat dissipation pipe 204 is conducted to second gasket 120 through refrigerator main body 200. When this heat heats second gasket 120, the surrounding air is heated by heat dissipation from second gasket 120, and consequently, the cooling efficiency of the storage compartment might be reduced.

However, second gasket 120 of the present embodiment includes heat insulator 121, and is therefore not easily heated by the heat from heat dissipation pipe 204. Accordingly, reduction in cooling efficiency of the storage compartment due to heat dissipation from second gasket 120 can be suppressed.

In addition, second gasket 120 does not make contact with door 300 and has a thickness that defines a gap between second gasket 120 and door 300, and thus, even when the temperature of second gasket 120 is slightly raised by the heat of heat dissipation pipe 204, the heat is not directly conducted to door 300 through second gasket 120. Thus, door 300 is not heated by the heat of heat dissipation pipe 204, and reduction in cooling efficiency of the storage compartment due to the temperature rise of door 300 can be prevented.

If second gasket 120 can make contact with door 300, the storage compartment might be almost completely isolated from the outside air; however, in the present embodiment, a gap is provided between second gasket 120 and door 300 in view of the possibility of heat conduction from heat dissipation pipe 204 to door 300 through second gasket 120. It is to be noted that heat conduction to door 300 might be suppressed if second gasket 120 also has an air chamber as in first gasket 110; however, in that case, the configuration of second gasket 120 is complicated. In view of this, in the present embodiment, second gasket 120 merely functions as an auxiliary part of first gasket 110 without having a complicated configuration. In addition, since a gap is provided between second gasket 120 and door 300, closing of door 300 is not inhibited by second gasket 120 making contact with door 300.

Also, in the present embodiment, second gasket 120 is provided on refrigerator main body 200 side, and thus it is recognized that reduction in cooling efficiency of the storage compartment can be suppressed in comparison with the case where second gasket 120 is provided on door 300 side. That is, the heat of heat dissipation pipe 204 located on refrigerator main body 200 side is conducted to the interior of the storage compartment from the surface of inner case 202; however, when second gasket 120 is provided on refrigerator main body 200 side as in the present embodiment, the heat of heat dissipation pipe 204 is insulated by the heat insulator 121 provided in second gasket 120 on the surface of inner case 202. Accordingly, the heat is not easily conducted to the interior of the storage compartment, and reduction in cooling efficiency of the storage compartment can be suppressed.

Also, in the state where door 300 is closed, the actual gap between refrigerator main body 200 and door 300 is 2 to 3 mm except in the area of gasket 100, and, in the present embodiment, the gap is extremely narrowed by second gasket 120.

Further, in the present embodiment, second gasket 120 is provided on refrigerator main body 200 side, not door 300, which is a movable part, side, and therefore second gasket 120 can be attached in a simple manner. That is, particularly in refrigerating compartment 31 illustrated in FIG. 1, since first turning door 11 and second turning door 12 are provided, second gasket 120 is required to be attached to left and right turning doors 11 and 12 for six sides except in the central double-door part in the case where second gasket is provided on door 300 side. However, in the present embodiment, second gasket 120 needs to be attached to only four sides of the opening on refrigerator main body 200 side. Thus, the number of the components of second gasket 120 can be reduced, and the attaching operation can be simplified.

As described above, in the present embodiment, first gasket 110 and second gasket 120 are provided. First gasket 110 is provided on door 300, and when door 300 is closed, first gasket 110 makes contact with refrigerator main body 200 to close the storage compartment. Second gasket 120 is provided with heat insulator 121, and is provided on refrigerator main body 200 on the storage compartment side relative to the location where first gasket 110 adheres. Accordingly, it is possible to achieve refrigerator 10 that can suppress reduction in cooling efficiency due to second gasket 120 heated by heat dissipation pipe 204.

<2> Other Embodiments

While the invention made by the present inventor has been specifically described based on the preferred embodiments, it is not intended to limit the present invention to the above-mentioned preferred embodiments but the present invention may be further modified within the scope and spirit of the invention defined by the appended claims.

Figure 4:
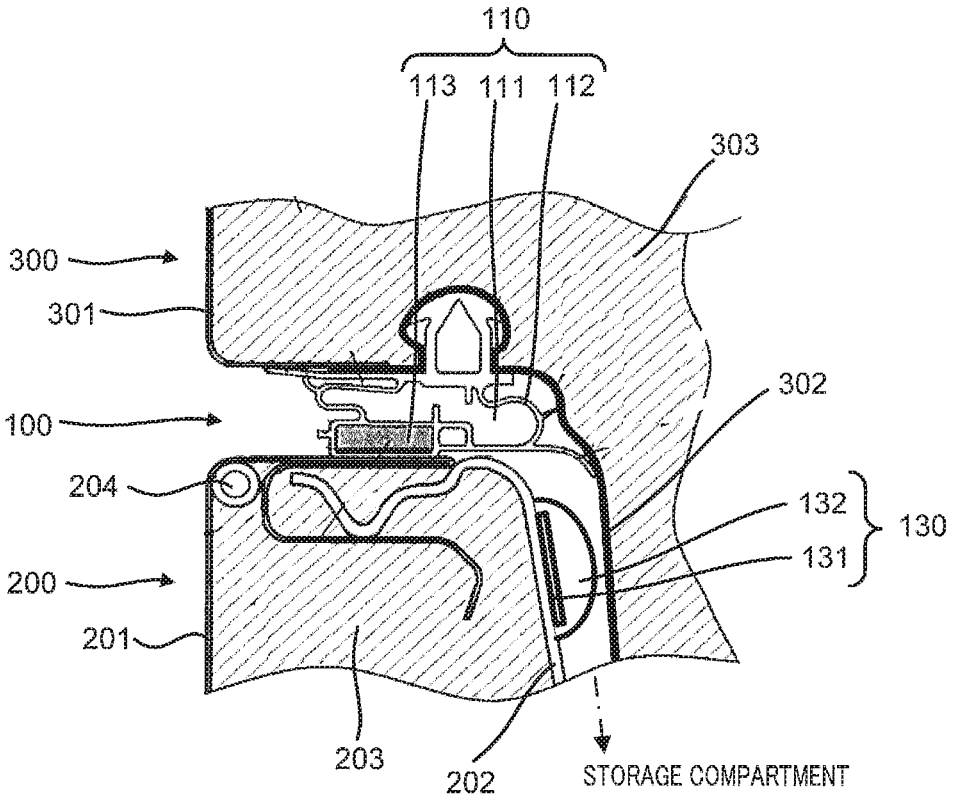
FIG. 4 is a sectional view illustrating a configuration of a gasket of another embodiment.

For example, second gasket 120 may be modified as illustrated in FIG. 4. Second gasket 130 illustrated in FIG. 4, in which components corresponding those of FIG. 3 are denoted with the same reference numerals, is different from second gasket 120 illustrated in FIG. 3 in its shape. Second gasket 130 illustrated in FIG. 4 has an elliptical cross-sectional surface. With this configuration, the surface area of second gasket 130 is reduced, and heat dissipation to the surface of second gasket 130 can be reduced, and as a result, reduction in cooling efficiency due to heat dissipation from second gasket 130 can be further suppressed. In the example illustrated in FIG. 4, heat insulator 131 is covered with covering member 132 having an elliptical cross-sectional surface.

Figure 5:
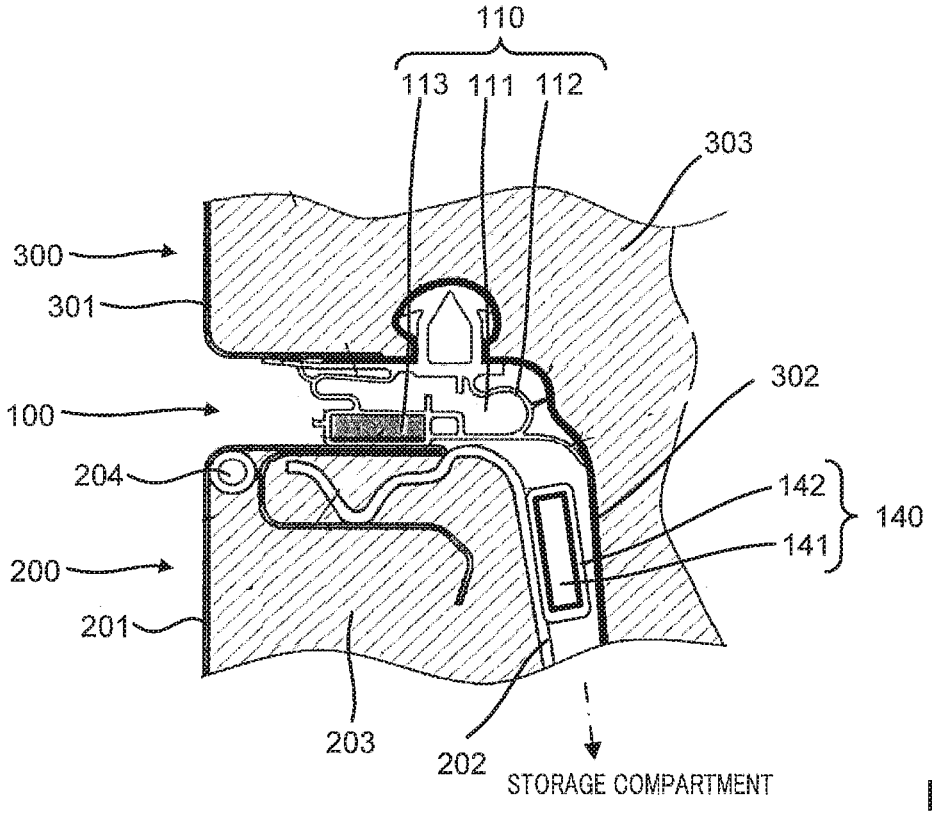
FIG. 5 is a sectional view illustrating a configuration of a gasket of another embodiment.

In addition, second gasket 120 may be modified as illustrated in FIG. 5. Second gasket 140 illustrated in FIG. 5, in which components corresponding those of FIG. 3 are denoted with the same reference numerals, is different from second gasket 120 illustrated in FIG. 3 in its shape. In second gasket 140 illustrated in FIG. 5, heat insulator 141 is covered with covering member 142 having a pouch shape and made of a resin. With this configuration, the volume of heat insulator 141 can be increased, and accordingly the heat insulating property of second gasket 140 can be further increased.

While heat insulators 121, 131 and 141 are covered with covering members 122, 132 and 142 having a rigidity higher than that of heat insulators 121, 131 and 141 in the embodiment, covering members 122, 132 and 142 may be omitted in the case where a heat insulator that has sufficient rigidity even in an exposed state is used. It should be noted that, in general, a heat insulator has a foaming structure and cannot provide sufficient rigidity, and it is therefore effective to use a covering member for increasing the rigidity from the viewpoint of increasing the durability.

While second gasket 120 does not make contact with door 300 when door 300 is closed in the embodiment, second gasket door 300 may make contact with door 300. Even in this case, since second gasket 120 has heat insulator 121, the heat conduction from heat dissipation pipe 204 to door 300 can be suppressed. However, it is preferable that second gasket 120 do not make contact with door 300 since, with such a configuration, the heat conduction from heat dissipation pipe 204 to door 300 can be further suppressed, and closing of door 300 is not inhibited.

Naturally, the present disclosure is applicable to a business-grade refrigerator that stores objects as the above-mentioned refrigerator.

INDUSTRIAL APPLICABILITY

The present disclosure is applicable not only to a consumer refrigerator, but also to various warming and cooling heating apparatuses such as a business-grade refrigerator in which the sealing property of the door is ensured with a gasket, and can achieve energy saving in such warming and cooling heating apparatuses.

REFERENCE SIGNS LIST

10 Refrigerator
11, 12 Turning door
13 Ice compartment door
14, 15 Freezing compartment door
16 Vegetable compartment door
20, 200 Refrigerator main body
21 Compressor
22 Condenser
23 Cooling fan
31 Refrigerating compartment
32 Ice compartment
33, 34 Freezing compartment
35 Vegetable compartment
100 Gasket
110 First gasket
111 Air chamber
112 Flexible section
113 Magnet
120, 130, 140 Second gasket
121, 131, 141, 203, 303 Heat insulator
122, 132, 142 Covering member
300 Door
201 Outer case
202 Inner case
204 Heat dissipation pipe
301 Outer door plate
302 Inner door plate

The invention claimed is:

1. A refrigerator comprising:

a first gasket provided on a door of the refrigerator, and configured to make contact with a refrigerator main body when the door is closed; and a second gasket disposed on a side surface of the refrigerator main body at a position on a storage compartment side, and including a heat insulator, wherein:

the first gasket and the second gasket are provided between the door and the refrigerator main body, the second gasket is located on the storage compartment side relative to the first gasket in the refrigerator, when the door is closed, the second gasket narrows and reduces a gap between the door and the refrigerator main body without making contact with the door, the second gasket is fixed on the side surface of the refrigerator main body with an adhesive agent, and the side surface of the refrigerator main body is flat.

2. The refrigerator according to claim 1, wherein the second gasket includes a covering member that covers the heat insulator and has a rigidity higher than a rigidity of the heat insulator.

3. The refrigerator according to claim 1, wherein the second gasket has an elliptical cross-sectional surface.

4. The refrigerator according to claim 1, wherein, in the second gasket, the heat insulator is covered with a covering member made of a resin material and having a pouch shape.

5. The refrigerator according to claim 1, wherein the heat insulator includes aerogel and fiber.

* * * * *